US010957995B1

(12) United States Patent
Belisle

(10) Patent No.: US 10,957,995 B1
(45) Date of Patent: Mar. 23, 2021

(54) ELECTRICAL CONNECTION PROTECTION

(71) Applicant: Hamilton Sundstrand Corporation, Charlotte, NC (US)

(72) Inventor: Francis C. Belisle, Roscoe, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 16/678,618

(22) Filed: Nov. 8, 2019

(51) Int. Cl.
*H01R 9/22* (2006.01)
*H01R 9/18* (2006.01)
*H01R 11/12* (2006.01)

(52) U.S. Cl.
CPC ..... *H01R 9/223* (2013.01); *H01R 9/18* (2013.01); *H01R 11/12* (2013.01)

(58) Field of Classification Search
CPC ..... H01R 9/223
See application file for complete search history.

(56) References Cited

U.S. PATENT DOCUMENTS

| | | | | |
|---|---|---|---|---|
| 4,559,413 | A | 12/1985 | Logstrup et al. | |
| 5,562,490 | A | 10/1996 | Rybolt et al. | |
| 6,709,274 | B2 | 3/2004 | Lazaro, Jr. et al. | |
| 10,109,443 | B2 | 10/2018 | Keller | |
| 10,212,838 | B2 | 2/2019 | McPherson et al. | |
| 10,381,754 | B1 * | 8/2019 | Wu | H01R 9/2416 |

* cited by examiner

*Primary Examiner* — Ross N Gushi
(74) *Attorney, Agent, or Firm* — Locke Lord LLP; Scott D. Wofsy; Georgi Korobanov

(57) ABSTRACT

An electrical assembly including a first conductor, at least a second conductor parallel and electrically isolated from the first conductor, a component connecting to the first conductor and the second conductor, a cover including fastener slots each configured for receiving a fastener therein configured for securing the cover partially within the component, and including at least two isolation slots each configured for receiving and electrically and mechanically isolating the first conductor and the second conductor from each other and from each fastener, and a base configured to secure and align the cover and the component.

12 Claims, 3 Drawing Sheets

ELECTRICAL CONNECTION PROTECTION

BACKGROUND

Technological Field

The present disclosure relates to electrical connection protection, and more particularly to high voltage and high altitude electrical protection.

Description of Related Art

A variety of devices are known to create electrical joints. The standard for electrical connections include bolted joints that include a dielectric over placed over the electrical joints, and the cover typically includes large opening, which provide minimal protection for personnel servicing the area around the joint. The covers typically only provide protection again large debris, but do not provide protection against internal voltage breakdown or small debris items.

The present standard for electrical connections of high amperage components such as relays or contactors, or fuses, etc. is to have the electrical main power connections provided by threaded bolts (or terminal studs). Then these electrical bolted joints (components to bus bars or aircraft power feeders to component studs) have a dielectric cover placed over the electrical joints, and the covers typically have large openings for tolerances and mechanical clearances around the bolted joints, which provide minimum personnel protection from electrical connections.

The covers are designed generically and have features which provide (primarily) only protection from accidental personnel or tool physical contact with electrical connections. The covers do not provide protection for personnel from reaching (touching) around the cover and touching the electrical feeder or component connections. The covers provide protection against large Foreign Object Debris (FOD) items, but not against small or thin FOD elements of materials, and do not provide high voltage break down physical protection.

With the increase of aircraft voltages (above 235 VAC and 270 VDC), the dielectric air gap spacing and surface creepage spacing (along a dielectric surface material between conductors) in the present cover designs are not adequate break down protection for medium high voltages (Voltages >500 V).

There is a need in the art for electrical joints having improved FOD and voltage protection. There also remains a need in the art for such joints and components that are economically viable. The present disclosure may provide a solution for at least one of these remaining challenges.

SUMMARY OF THE INVENTION

An electrical assembly includes a first conductor, at least a second conductor parallel and electrically isolated from the first conductor, a component connecting to the first conductor and the second conductor, a cover including fastener slots each configured for receiving a fastener therein configured for securing the cover partially within the component, and including at least two isolation slots each configured for receiving and electrically and mechanically isolating the first conductor and the second conductor from each other and from each fastener, and a base configured to secure and align the cover and the component.

Each of the two isolation slots of the cover can be wider than each of the fastener slots.

The base can attach to each of the conductors by a fastener. The base can include multiple grooves, and the cover includes multiple interior walls configured to align and insert into the each corresponding groove.

The fastener slots and the isolation slots can defined by the interior walls. The electrical component can include multiple grooves configured to align and receive corresponding tabs of the interior walls of the cover. The cover can include a pair of outer walls, and wherein the interior walls extend further downward from a top surface of the cover than each of the outer walls extend downward from the top surface. The cover can includes a top surface which positioned below a top surface of the component. Each outer wall of the cover can be adjacent to and flush with at least one interior wall of the cover. The outer walls can project forward further than the interior walls. The cover can surrounds the first conductor and the second conductor and includes a dielectric material.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein.

DETAILED DESCRIPTION

Figure 1:
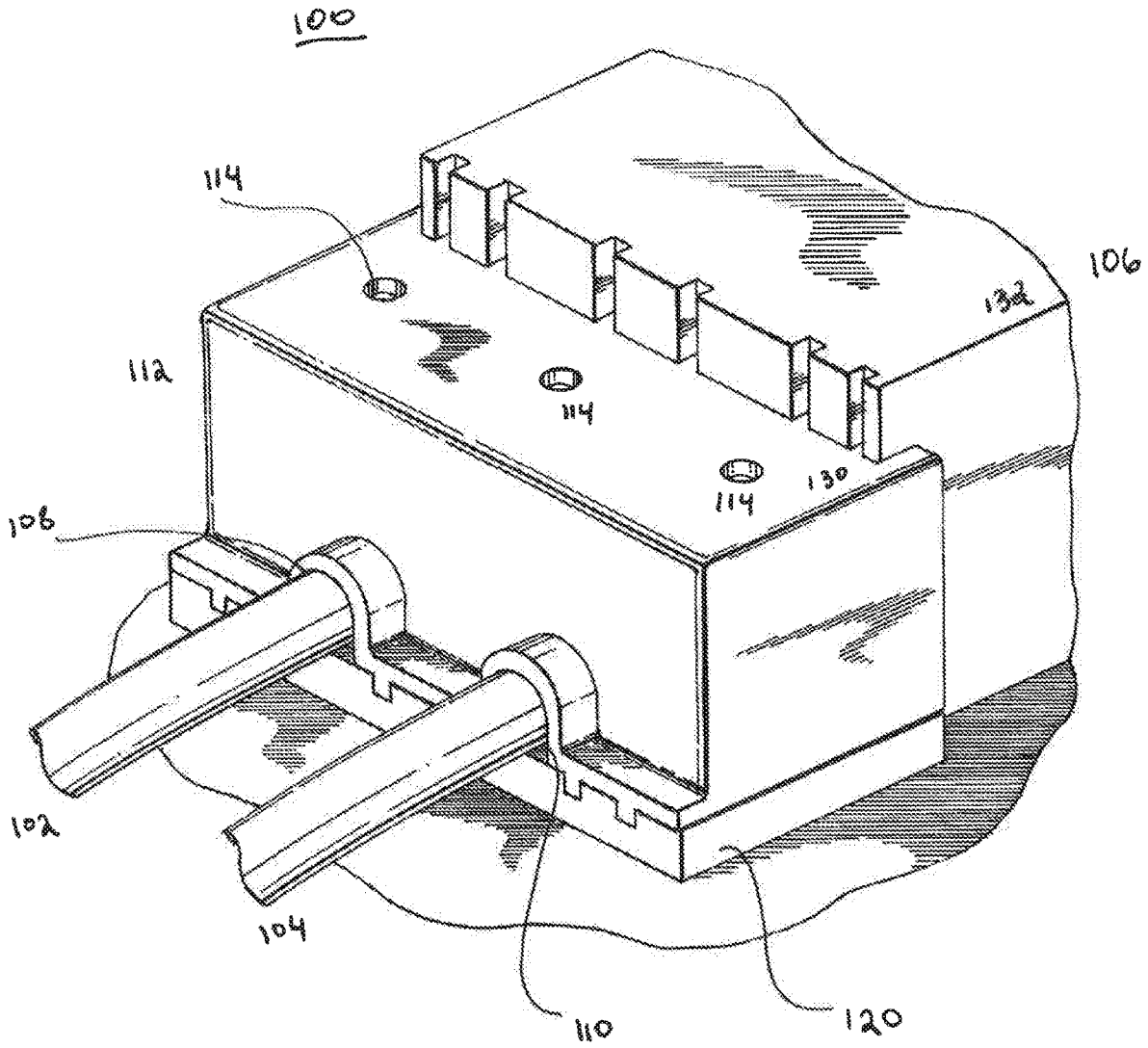
FIG. 1 is a perspective view of an electrical assembly according to the present disclosure.

Reference will now be made to the drawings wherein like reference numerals identify similar structural features or aspects of the subject invention. For purposes of explanation and illustration, and not limitation, a partial view of an exemplary embodiment of an electrical assembly in accordance with the invention is shown in FIG. 1 and is designated generally by reference character 100. Other aspects of the assembly, are provided in FIGS. 2-3, as will be described. The methods and systems of the invention can be used to improve protection of electrical components in high voltage situations. The description and figures are aimed at two phase representation of 2-phase system (i.e. +/−DC System) but can be applied to a three or more phase system, and to AC voltage systems.

FIG. 1 shows an electrical assembly 100 including a first conductor 102 and a second conductor 104 parallel and electrically isolated from the first conductor 102. Both conductors 102/104 are partially housed within a component 106 within a designated first conductor opening 108 and a second conductor opening 110 spaced apart from the first conductor opening 108. A cover 112, including a dielectric material, is secured by captive fasteners 114, is partially housed within the component 106 and mounting base 120.

The cover 112 includes a top surface 130 which sits below a top surface 132 of the component 106. Again, this system can be applied to larger systems, having more phases, which can also use more connectors.

Figure 2:
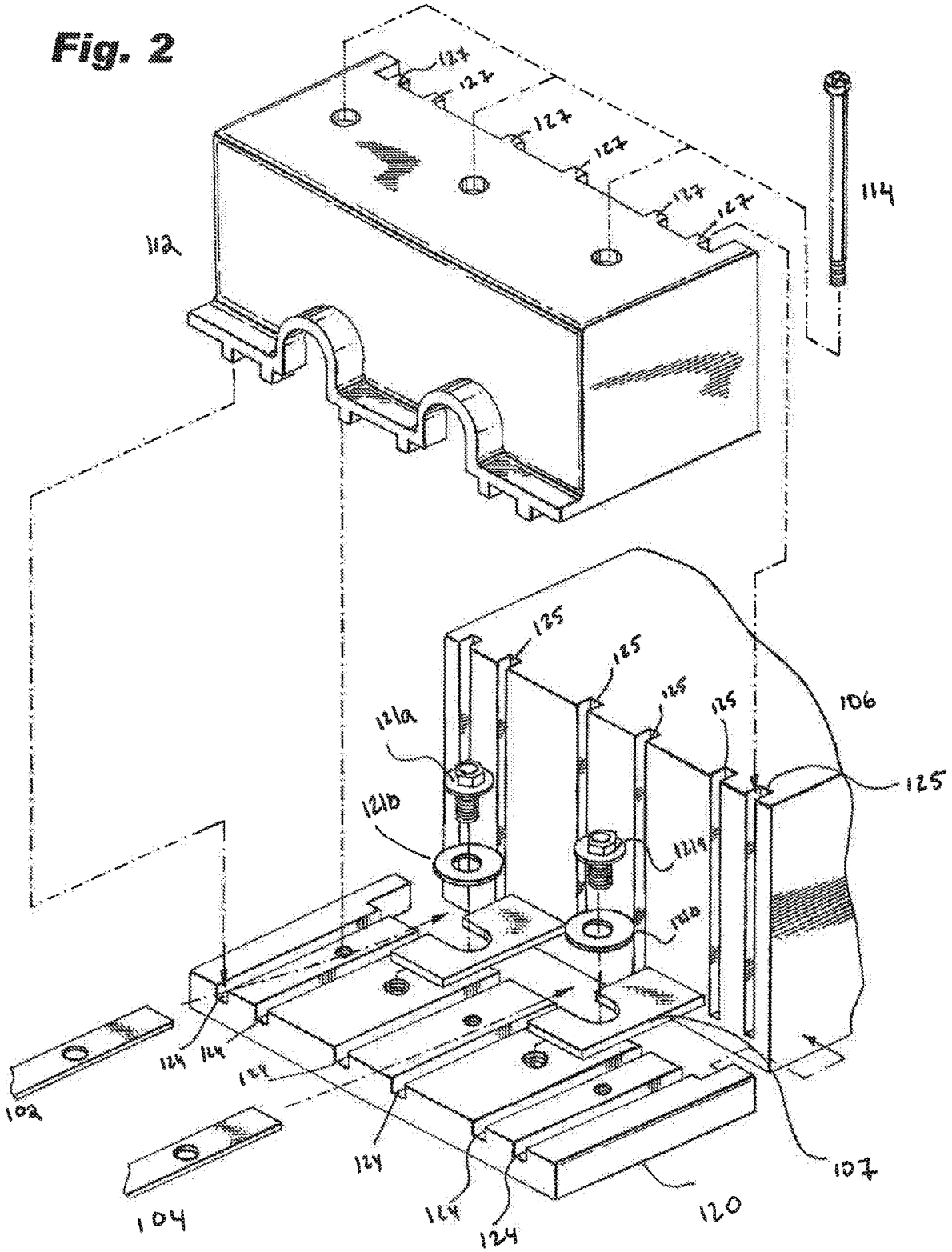
FIG. 2 is an exploded view of FIG. 1, showing the cover, base, and component separately.

FIG. 2 shows electrical connectors 102/104 exploded from the fasteners 121*a* and 121*b*, which fasten the electrical connectors 102/104 to the connectors 107 of the component 106 and to the mounting base 120. This connection allows for easy repair and service in case of damage to the assembly 100. The mounting base 120 includes multiple grooves 124, and the cover 112 includes multiple interior walls 126 configured to align and insert into the each corresponding groove 124. The grooves 124 are aligned with interior walls 126 of the cover 112. Each interior wall 126 includes a front facing tab 127 each of which aligns with grooves 125 of the component 106 of such that when the tabs 127 of the interior walls 126 are inserted into the grooves 125, the cover 112 partially enters the component 106.

Figure 3:
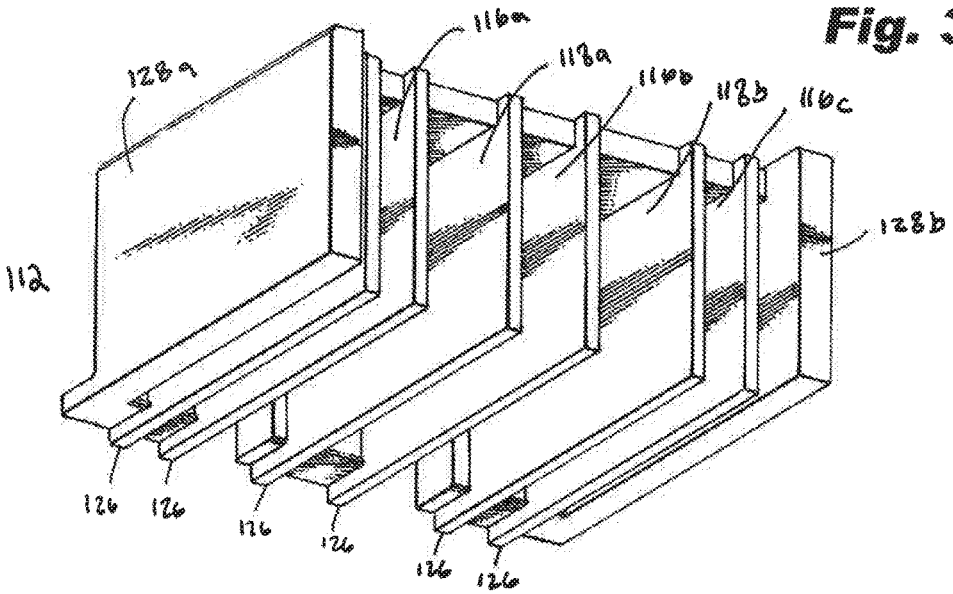
FIG. 3 is an isometric view of the cover of FIG. 1, showing the cover from a reverse angle of FIG. 2.

FIG. 3 shows the cover 112 includes two isolation slots 118*a/b* configured for receiving and electrically and mechanically isolating the first conductor 102 and the second conductor 104 from each other and from captive fasteners 114. The fastener slots 116*a-c* and the isolation slots 118*a/b* are defined by interior walls 126. It is also conceived that a greater number of electrical conductors and phases could be used with an equal and corresponding number of isolations slots of the cover and component. The two isolation slots 118*a/b* are each wider than each of the fastener slots 116*a-c*. This allows for various with connectors to be used with the assembly 100. The cover 112 includes a pair of outer walls 128*a/b*, and the interior walls 126 extend further downward from a top surface 130 of the cover 112 than each of the outer walls 128 extend downward from the top surface 130, such that when the interior walls 126 are inserted into the grooves 124, the interior walls 126 are able to prevent a line of sight between each electrical connector 102/104 and each captive fastener 114. Each outer wall 128 of the cover 112 is adjacent to and flush with at least one interior wall 126.

Figure 4:
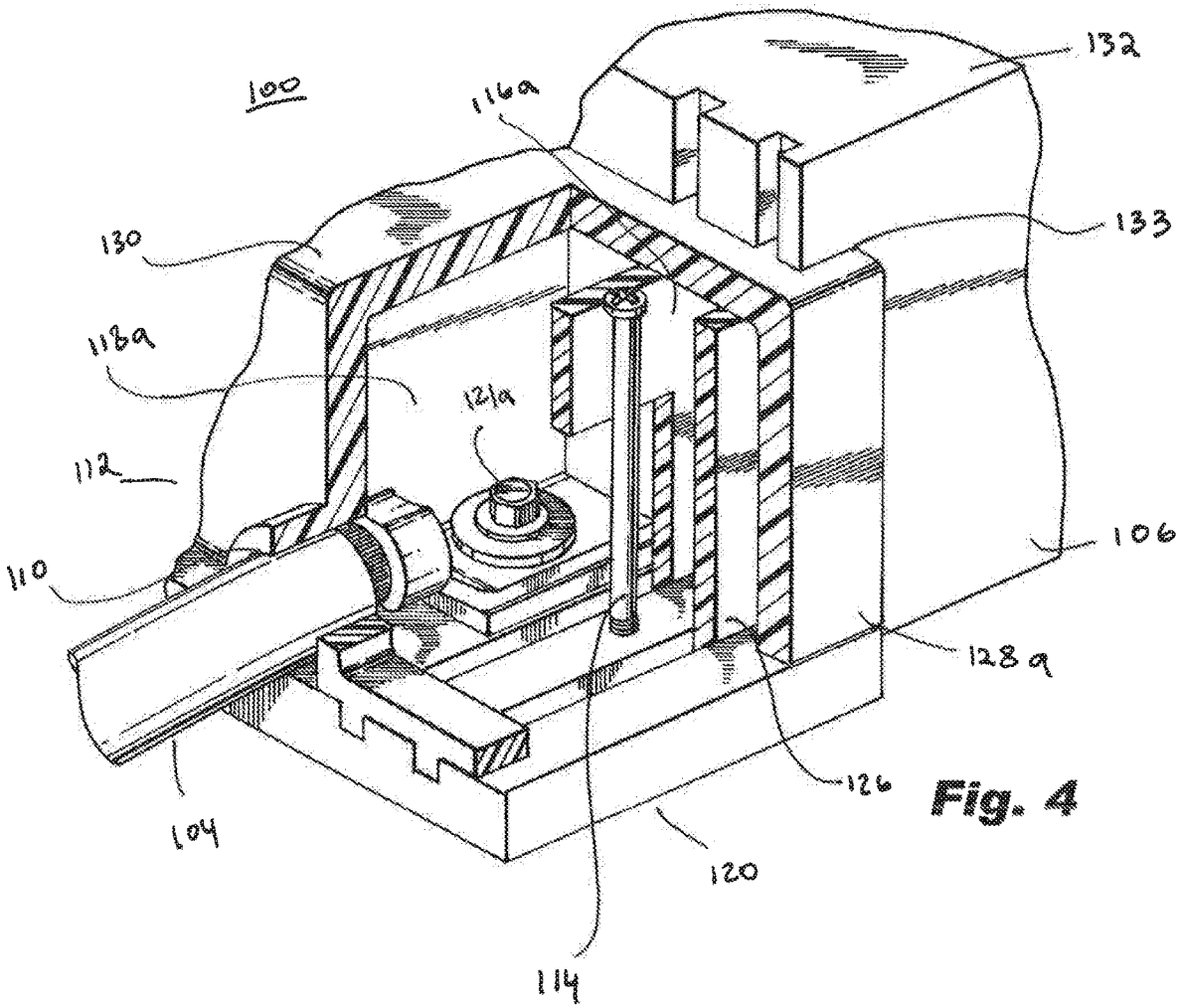
FIG. 4 is a partial isometric view of the assembly of FIG. 1, showing the alignment of the walls of the cover and the slots of the base inside the cover of FIG. 1.

FIG. 4 shows the mounting base 120 within the assembly 100 aligned with cover 112 and the component 106. The second conductor 104 is shown as attached to the mounting base 120 and secured by fastener 121*a* and 121*b* within isolation slot 118*a*. The cover 112 is secured to mounting base 120 by captive fastener 114 within the faster slot 116*a*. Corner 133 of the cover 112 wraps around the component 106 Again, it is conceived that a greater number of electrical conductors could be used with an interface that matches up to each conductor.

With physical protective cover features of grooves and tabs between the electrical component 106, component installation (mounting base 120), and the dielectric environmental installation protection assembly cover 112, the design allows for the installed assembly to provide for dielectric protection and high voltage dielectric protection, in high altitude applications by creating long creepage (surface) distances between conductors, and no line of sight between conductors to prevent contamination faults.

The physical feature of dielectric protection for the application of aerospace high voltage incorporated design features to prevent foreign object damage (FOD) faults, and increases physical protection for exposed electrical conductors from external contact (tools or personnel touch).

The physical material construction can be designed for arc resistant materials around the electrical conductors, and materials for mechanical strength at the alignment groves/flanges in the installation.

The methods and systems of the present disclosure, as described above and shown in the drawings, provide for an electrical assembly with superior properties including increased reliability and stability, and reduced size, weight, complexity, and/or cost. While the apparatus and methods of the subject disclosure have been showing and described with reference to embodiments, those skilled in the art will readily appreciate that changes and/or modifications may be made thereto without departing from the spirit and score of the subject disclosure.

What is claimed is:

1. An electrical assembly comprising:

a first conductor;

at least a second conductor parallel and electrically isolated from the first conductor;

a component connecting to the first conductor and the second conductor;

a cover including fastener slots each configured for receiving a fastener therein configured for securing the cover partially within the component, and including at least two isolation slots each configured for receiving and electrically and mechanically isolating the first conductor and the second conductor from each other and from each fastener; and a base configured to secure and align the cover and the component, wherein the base includes multiple grooves, and the cover includes multiple interior walls configured to align and insert into the each corresponding groove.

2. The electrical assembly of claim 1, wherein each of the two isolation slots of the cover are wider than each of the fastener slots.

3. The electrical assembly of claim 1, wherein the base attaches to each of the conductors by a fastener.

4. The electrical assembly of claim 1, wherein the fastener slots and the isolation slots are defined by the interior walls.

5. The electrical assembly of claim 1, wherein the electrical component includes multiple grooves configured to align and receive corresponding tabs of the interior walls of the cover.

6. The electrical assembly of claim 1, wherein the cover includes a pair of outer walls, and wherein the interior walls extend further from a surface of the cover than each of the outer walls extend from the surface of the cover.

7. The electrical assembly of claim 1, wherein the cover does not include an outer surface flush with an outer surface of the component.

8. The electrical assembly of claim 1, wherein each outer wall of the cover is adjacent to and flush with at least one interior wall.

9. The electrical assembly of claim 8, wherein the outer walls project forward further than the interior walls.

10. The electrical assembly of claim 1, wherein the cover surrounds the first conductor and the second conductor.

11. The electrical assembly of claim 1, wherein the cover includes a dielectric material.

12. A method for electrically isolating a first conductor from a second conductor comprising:

placing a first conductor;

placing at least a second conductor parallel to the first conductor;

connecting the first conductor and the second conductor to an electrical component; and electrically isolating the first conductor from the second conductor by a cover including fastener slots each configured for receiving a fastener therein configured for securing the cover partially within the component, and including at least two isolation slots each configured for receiving and electrically and mechanically isolating the first conductor and the second conductor from each other and from each fastener, and a base configured to secure and align the cover and the component wherein the base includes multiple grooves, and the cover includes multiple interior walls and further comprising aligning and inserting the interior walls into each corresponding groove.

* * * * *